US007506992B2

(12) United States Patent
Carter

(10) Patent No.: US 7,506,992 B2
(45) Date of Patent: Mar. 24, 2009

(54) LED CAP LIGHT

(76) Inventor: William Rex Carter, 1935 McIntosh Rd., Paris, TN (US) 38242

( * ) Notice: Subject to any disclaimer, the term of this patent is extended or adjusted under 35 U.S.C. 154(b) by 74 days.

(21) Appl. No.: 12/003,480

(22) Filed: Dec. 26, 2007

(65) Prior Publication Data

US 2008/0232092 A1 Sep. 25, 2008

Related U.S. Application Data

(63) Continuation of application No. 60/896,206, filed on Mar. 21, 2007.

(51) Int. Cl.
*F21V 21/088* (2006.01)

(52) U.S. Cl. ..... 362/105; 362/106; 362/191; 2/209.13; 2/422

(58) Field of Classification Search ..... 362/105, 362/106, 190, 191, 234, 253, 249; 2/209.13, 2/422

See application file for complete search history.

(56) References Cited

U.S. PATENT DOCUMENTS

| | | | | |
|---|---|---|---|---|
| 5,408,393 | A | 4/1995 | Becker | |
| 5,485,358 | A | 1/1996 | Chien | |
| 6,575,588 | B2 | 6/2003 | Strehl | |
| 6,604,837 | B2 | 8/2003 | Sandberg | |
| 6,634,031 | B1 | 10/2003 | Schlapkohl | |
| 6,733,150 | B1 | 5/2004 | Hanley | |
| 6,895,602 | B2 | 5/2005 | Schlapkohl | |
| 7,000,841 | B2 | 2/2006 | Becker | |
| 7,052,154 | B2 | 5/2006 | Vanderschuit | |
| 7,111,956 | B2 | 9/2006 | Brown | |
| 7,163,309 | B2 | 1/2007 | Sohn | |
| 7,234,831 | B1 * | 6/2007 | Hanley | 362/106 |
| 2002/0093818 | A1 * | 7/2002 | Mele | 362/203 |
| 2004/0145888 | A1 * | 7/2004 | Sohn | 362/105 |
| 2006/0232962 | A1 | 10/2006 | Altman | |
| 2007/0109768 | A1 * | 5/2007 | Sohn | 362/106 |

OTHER PUBLICATIONS

Gadget Brando 5 LED Cap Light, the gadgeteer website: http://the-gadgeteer.com/review/gadget_brando_5_led_cap_light, 11 pages printed from the Internet on Nov. 23, 2007.

* cited by examiner

*Primary Examiner*—Laura Tso
(74) *Attorney, Agent, or Firm*—Richard C. Litman

(57) ABSTRACT

The LED cap light has a housing with an arcuate top surface. LED's on the housing front surface are disposed at intervals along a laterally extending arc. A power switch is on the housing bottom. A battery is inside the housing. Electronic circuitry in the housing is responsive to the power switch to select at least one central LED for illumination while the remaining LEDs are powered off, and to select the remaining LEDs for illumination while the at least one central LED is powered off, and to power off all LEDS. The at least one central LED is designed to emit a substantially monochromatic primary color. Two steel spring clips are attached to the housing and extend above the top surface of the housing. Spring clip surfaces contact the housing top surface to provide a resilient frictional force for attachment to a hat visor.

17 Claims, 5 Drawing Sheets

LED CAP LIGHT

CROSS-REFERENCE TO RELATED APPLICATION

This application claims the benefit of U.S. Provisional Patent Application Ser. No. 60/896,206, filed Mar. 21, 2007.

BACKGROUND OF THE INVENTION

1. Field of the Invention

The present invention relates to a clip-on LED light, and in particular to an LED cap light, which provides a clip-on LED light that is removably attachable to a hat brim, visor, or the like.

2. Description of the Related Art

Generally, a cap is used for protection from the elements during sporting activities such as hunting, or the like. In addition, a cap may be used merely for fashion. Regardless of one's purpose for wearing a cap, there arises the need for practical illumination of one's surroundings at dusk or night-time. For example, a hunter may wear a camoflauge hat to blend in with the surroundings and not scare prey away. Often times the hunter may end up stalking the animal into a dark place such as a tunnel, a mine, dense forest, and the like. Such places require illumination to keep the hunter safe.

Various attempts have been made to give hunters the option of hands free illumination during prey stalking activities. For example, clip type lights were developed. However until the present invention, they generally included a clip light having only three white lights for illumination. Such lights have proved to be inadequate for the hunter because the plastic clip, being unitarily formed from a plastic casing of the lighting unit, is easily breakable. Moreover, a major drawback of existing clip-on lights is that the white lights draw bugs while scaring away animal prey.

Thus, an LED cap light solving the aforementioned problems is desired.

SUMMARY OF THE INVENTION

The LED cap light has a housing including a top surface, the top surface having an arcuate contour to provide a snug fit underneath a similarly shaped hat visor. A plurality of LED's on the front surface of the housing are disposed at intervals along an arc extending between lateral sides of the front surface. A power switch is provided on a bottom surface of the housing. A battery is provided in the interior of the housing. Electronic circuitry is disposed in the housing, the electronic circuitry being responsive to the power switch to select at least one central LED for illumination while the remaining LEDs are powered off, and to select the remaining LEDs for illumination while the at least one central LED is powered off and to power off all LEDS. The at least one central LED is designed to emit a substantially monochromatic primary color. At least two steel spring clips are attached to the housing and extend above the top surface of the housing. Spring clip surfaces are in contact with the housing top surface to provide a resilient frictional force that retains the light source in position juxtaposed to the visor when the visor is interposed between the spring clip and the top surface of the housing.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
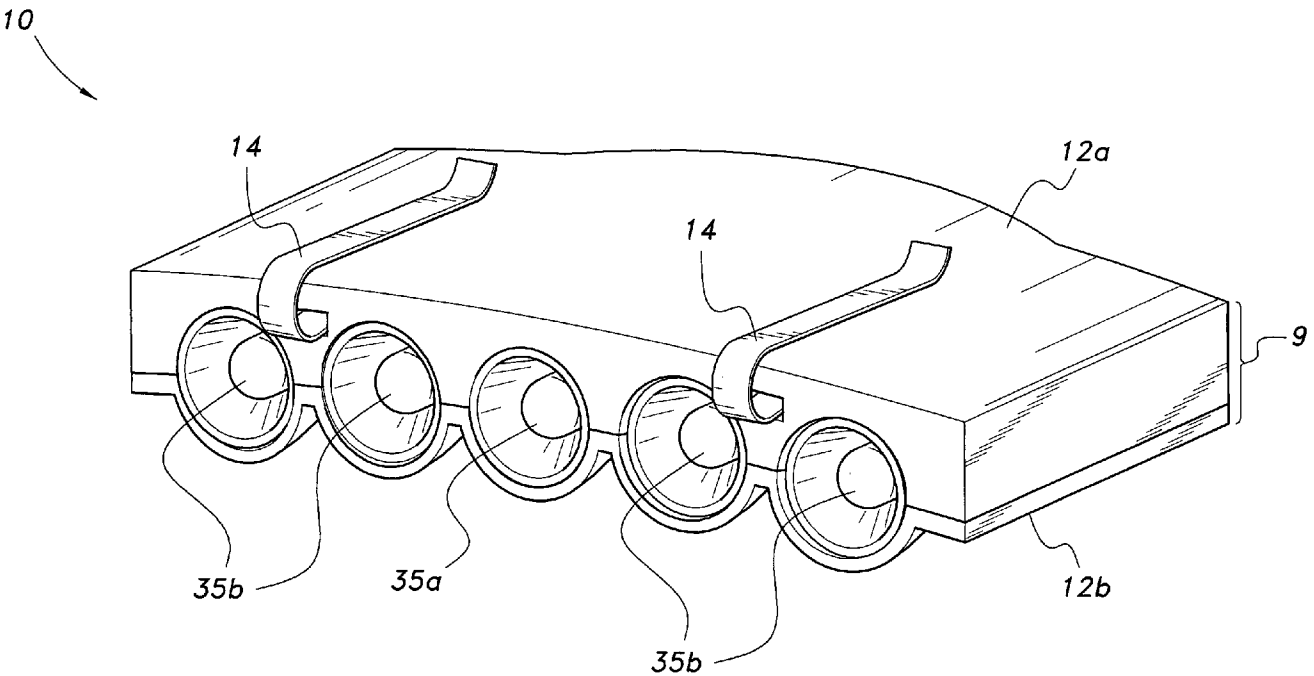
FIG. 1 is a perspective view of an LED cap light according to the present invention.
Figure 2:
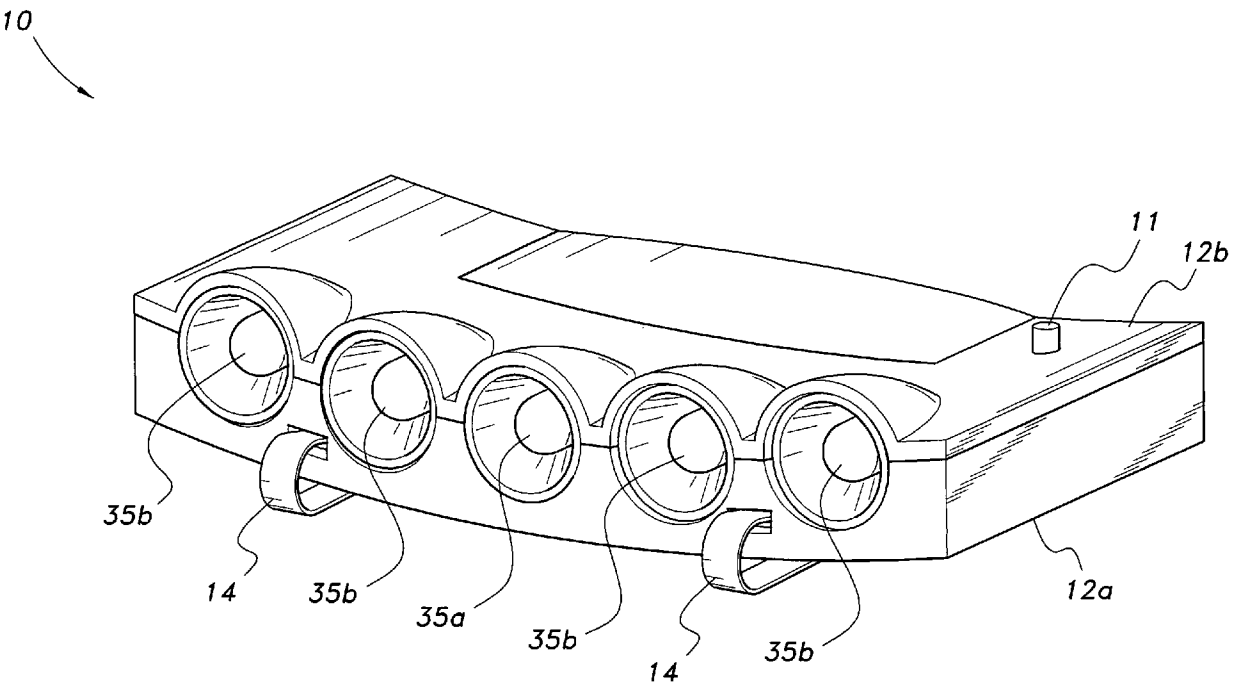
FIG. 2 is a perspective view of a LED cap light according to the present invention, the cap light being inverted to show the power switch.
Figure 3:
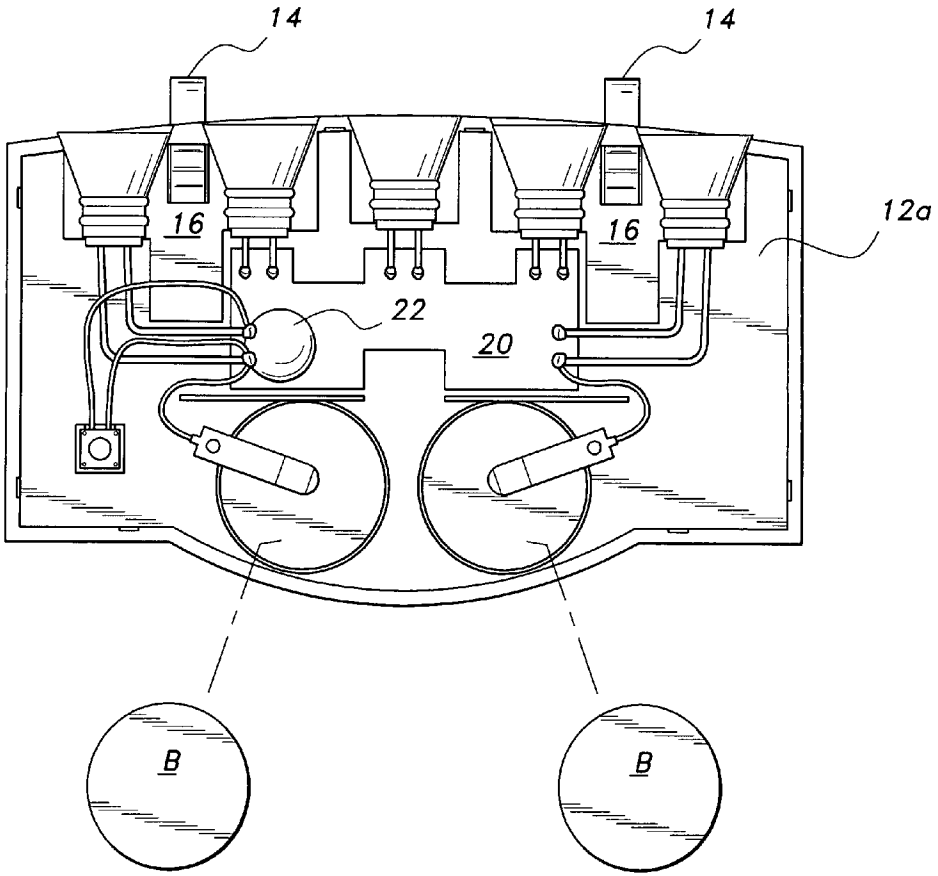
FIG. 3 is a top view of an LED cap light according to the present invention with the housing cover being removed to show the arrangement of components within the housing.
Figure 4:
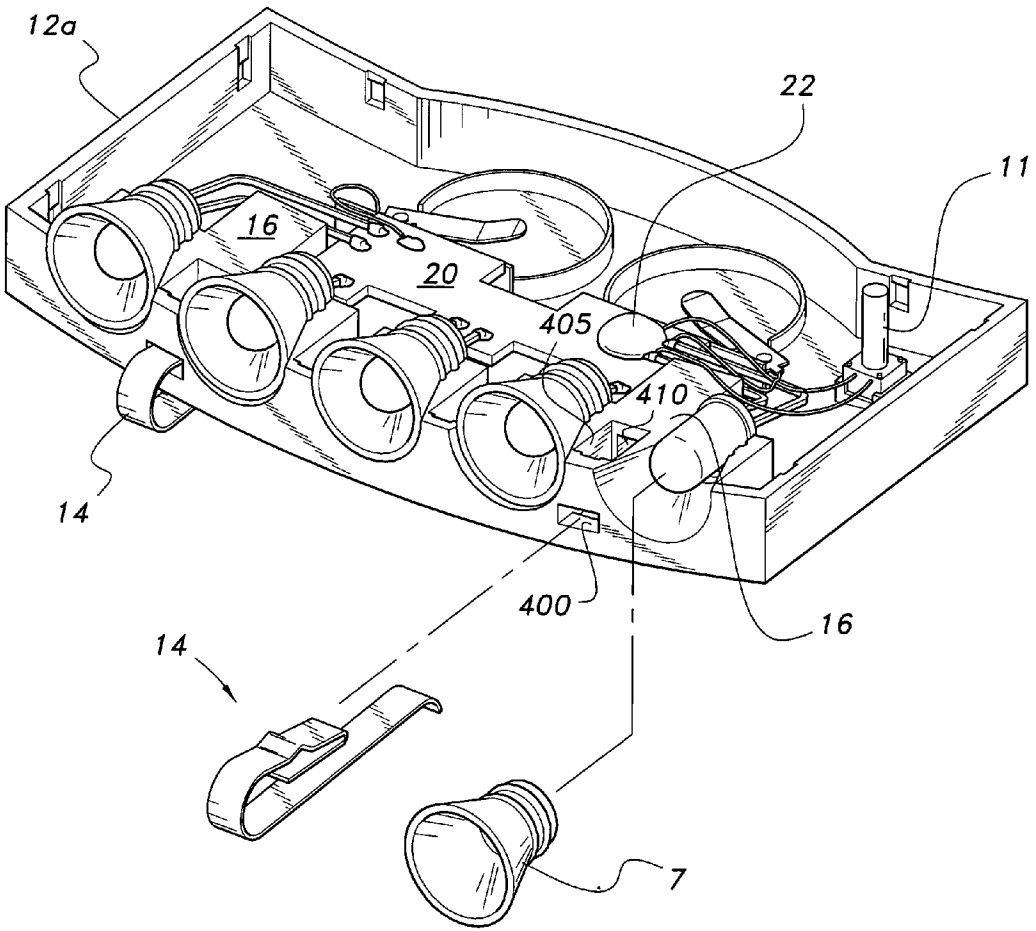
FIG. 4 is a partially exploded perspective view of an LED cap light according to the present invention, shown with the housing inverted and the bottom case removed to show details thereof.
Figure 5:
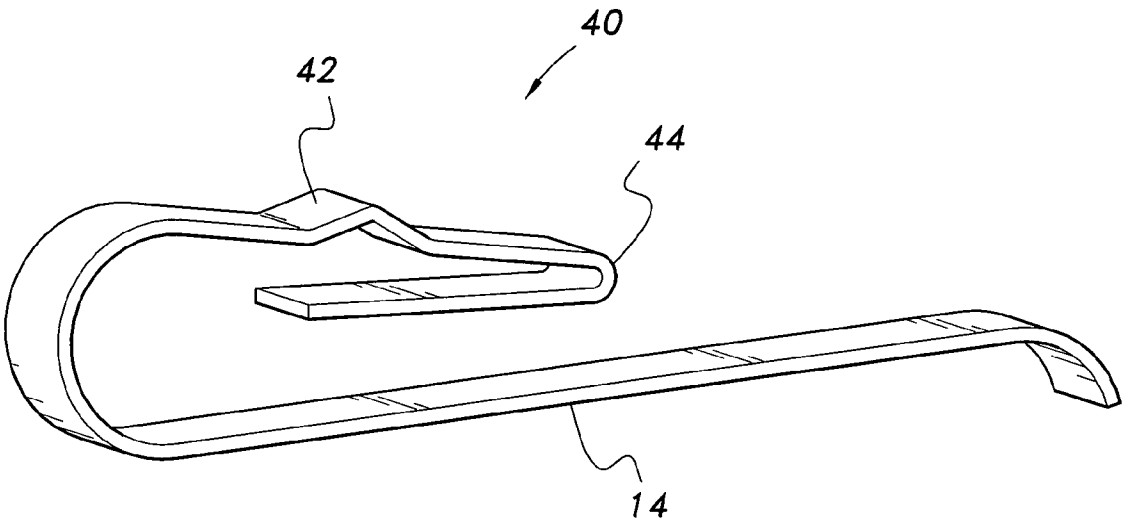
FIG. 5 is a perspective view of the spring clip of an LED cap light according to the present invention.

As shown in FIGS. 1-5, the present invention is an LED cap light 10 that has a housing 9 with an arcuate top surface. The housing 9 may be bifurcated into an upper housing portion 12*a* and a lower housing portion 12*b*, the two housing portions, when joined together, defining the top surface, lateral sides, a front surface and a bottom surface of the housing 9. The entire housing 9 may have a camouflage finish layer that matches a use environment for stealthy operation while a user is wearing the cap light 10.

LED's 35*a* and 35*b* on the housing front surface are disposed at intervals, preferably along a laterally extending arc that follows a curvature of the arcuate top surface. Reflectors 7 may be coaxially disposed around the LEDs 35*a* and 35*b* to redirect scattered light emanating from the LEDs into a desired forward direction. A power switch 11 is preferably disposed on the housing bottom surface. At least one battery B, preferably a 3-volt lithium having a button styled casing, is disposed inside the housing 9. Electronic circuitry 20 is disposed in the housing 9, the electronic circuitry 20 being responsive to the power switch 11 via power selector electronic circuitry 22 to select at least one central LED 35*a* for illumination while the remaining LEDs 35*b* are powered off, and to select the remaining LEDs 35*b* for illumination while the at least one central LED 35*a* is powered off, and to power off all LEDS 35*a* and 35*b*.

The at least one central LED 35*a* is designed to emit a substantially monochromatic primary color, e.g., red or green or blue based on a usage application dependent version of the cap light 10. For example, in a usage application where the user wishes to track down a blood trail of a wounded animal, a blue version of LED 35*a* is provided because the blue illumination will add contrast to the blood trail by making the blood trail appear black. In a mosquito avoiding user application, a red version of LED 35*a* is provided because the red illumination is invisible to mosquitoes. In an animal hunting or animal photography user application, either a red or green version of LED 35*a* is provided because the red or green illumination is invisible to most animals.

Two steel spring clips 14 are attached to the housing 9 and extend above the top surface of the housing 9. The attachment of each spring clip 14 to the housing 9 is comprised of a spring clip receiver 16 formed in upper housing 12*a*. The spring clip receiver 16 receives a front leading portion of spring clip 14. Front leading portion of spring clip 14 includes insertive nose 44, formed by a substantially non-angled portion that bendingly extends into an angled prong portion 40, the prong portion having a V shaped retaining bend 42.

The receiver 16 has a front opening 400 two side walls 405 and an internal rear opening 410. During assembly of the light cap 10, the insertive nose 44 is jammed into the openings of the receiver 16 until the retaining bend 42 clears a lower wall of front opening 400. The two side walls 405, front and rear openings 400 and 410 are dimensioned so that all surfaces of front portion of the clip 14 have a substantially high friction fit with the receiver 16 thereby preventing the clips 14 from being detached from upper housing portion 12*a*.

Strength and resilience of the steel spring clips 14 far exceeds capabilities of plastic clips found in related art products. Surfaces of spring clip 14 contact the housing top surface to provide the resilient frictional force for attachment of the cap light 10 to a hat visor.

It is to be understood that the present invention is not limited to the embodiment described above, but encompasses any and all embodiments within the scope of the following claims.

I claim:

1. An LED cap light, comprising:

a housing having a top surface dimensioned and configured to provide a snug fit to a visor of a hat, the housing defining an interior;

a plurality of light emitting diodes (LEDs) mounted on the front surface of the housing, the plurality of LEDs being disposed at intervals extending between lateral sides of the front surface and including at least one central LED;

a plurality of light reflectors disposed in coaxial relationship to the plurality of LEDs to redirect scattered light emanating from the LEDs into a desired forward direction;

a power switch mounted on the housing;

at least one battery disposed in the interior of the housing;

an LED circuit disposed in the housing, the circuit being responsive to the power switch to select the at least one central LED for illumination while the remaining LEDs are powered off, the at least one central LED emitting a substantially monochromatic primary color, and to select the remaining LEDs for illumination while the at least one central LED is powered off and to power off all LEDS; and at least two steel spring clips attached to the housing and extending above the top surface of the housing, the spring clips being in contact with the housing top surface to provide a resilient frictional force retaining the housing in position attached to the visor when the visor is interposed between the spring clip and the top surface of the housing.

2. The LED cap light according to claim 1, further comprising a spring clip receiver formed in an upper portion of the housing, the spring clip receiver being dimensioned for frictionally receiving a front leading portion of the spring clip in order to attach the spring clips to the housing.

3. The LED cap light according to claim 2, wherein the spring clip receiver further comprises: a front wall in the housing; a rear wall being disposed internally within the housing; two laterally opposing sidewalls being disposed internally within the housing; an aperture in the front wall leading to an internal portion of the housing; an aperture in the rear wall; the apertures and sidewalls being dimensioned to accept the front leading portion of the spring clip with a substantial amount of frictional force.

4. The LED cap light according to claim 3, wherein the front leading portion of the spring clip further comprises: an insertive nose formed by a substantially non-angled portion that bendingly extends into an angled prong portion having a retaining bend.

5. The LED cap light according to claim 1, wherein the top surface of the housing is arcuate.

6. The LED cap light according to claim 5, wherein the LEDs are disposed along an arc extending between lateral sides of the housing, the arc following a curvature of the arcuate top surface of said housing.

7. The LED cap light according to claim 1, wherein the power switch is located on a bottom surface of the housing.

8. The LED cap light according to claim 1, wherein the substantially monochromatic primary color emitted by the at least one central LED is red and the color emitted by the remaining LEDs is substantially white.

9. The LED cap light according to claim 1, wherein the substantially monochromatic primary color emitted by the at least one central LED is blue and the color emitted by the remaining LEDs is substantially white.

10. The LED cap light according to claim 1, wherein the substantially monochromatic primary color emitted by the at least one central LED is green, and the color emitted by the remaining LEDs is substantially white.

11. The LED cap light according to claim 1, wherein the at least one battery is a 3-volt lithium button battery.

12. The LED cap light according to claim 1, wherein the entire housing has a camouflage finish layer matching a use environment for stealthy operation while a user is wearing the cap light.

13. An LED cap light, comprising:

a housing including a top surface, the top surface being arcuate to provide a snug fit to a similarly shaped hat visor;

five light emitting diodes (LEDs) mounted on the front surface of the housing, the five LEDs being disposed at intervals along an arc extending between lateral sides of the front surface, the arc following a curvature of the arcuate top surface;

five light reflectors disposed in coaxial relationship to the five LEDs to redirect scattered light emanating from the LEDs into a forward direction;

a power switch disposed on a bottom surface of the housing;

two three-volt lithium button batteries disposed within the housing;

an electronic circuit disposed in the housing for being responsive to the power switch to select a central inboard LED for illumination having a substantially monochromatic primary color when the four remaining LEDs are powered off, and to select the four remaining outboard LEDs for illumination having a substantially white light when the central LED is powered off, and to power off all LEDS; and at least two steel spring clips attached to the housing and extending above the top surface of the housing, the spring clips being in contact with the housing top surface to provide a resilient frictional force retaining the light source in position attached to the visor when the visor is interposed between the spring clip and the top surface of the housing.

14. The LED cap light according to claim 13, wherein the entire housing has a camouflage finish layer matching a use environment for stealthy operation while a user is wearing the cap light.

15. The LED cap light according to claim 13, comprising a spring clip receiver formed in an upper portion of the housing, the spring clip receiver being dimensioned for frictionally receiving a front leading portion of the spring clip.

16. The LED cap light according to claim 15, wherein the spring clip receiver further comprises:

a front wall in the housing;

a rear wall disposed internally within the housing; two laterally opposing sidewalls being disposed internally within the housing;

an aperture in the front wall leading to an internal portion of the housing; and an aperture in the rear wall; the apertures and sidewalls being dimensioned to accept the front leading portion of the spring clip with a substantial amount of frictional force.

17. The LED cap light according to claim 16, wherein the front leading portion of the spring clip further comprises an insertive nose formed by a substantially non-angled portion extending into an angled prong portion having a V shaped retaining bend.

* * * * *